United States Patent [19]

Röck et al.

[11] 3,965,530

[45] June 29, 1976

[54] HINGE DEVICE

[75] Inventors: Erich Röck, Hochst; Bernhard Mages, Dornbirn, both of Austria

[73] Assignee: Blum Gesellschaft m.b.H., Hochst, Austria

[22] Filed: Mar. 26, 1975

[21] Appl. No.: 562,153

[30] Foreign Application Priority Data

Mar. 29, 1974 Austria ..... 2635/74

[52] U.S. Cl. ..... 16/130

[51] Int. Cl.[2] ..... E05D 7/04

[58] Field of Search ..... 16/129–134, 16/163, 164, 165, 166, 173, 183

[56] References Cited

UNITED STATES PATENTS 3,332,104 7/1967 Leach ..... 16/130

3,772,735 11/1973 Lautenschlaeger ..... 16/129

3,863,292 2/1975 Grunert et al. ..... 16/130 X

*Primary Examiner*—G. V. Larkin

*Attorney, Agent, or Firm*—Wenderoth, Lind & Ponack

[57] ABSTRACT

A hinge device includes at least one mounting plate which can be fixed onto one part of a piece of furniture and which is provided with guides into which laterally extending projections of a hinge arm or of an intermediate part belonging to the hinge arm are insertable.

7 Claims, 4 Drawing Figures

HINGE DEVICE

BACKGROUND OF THE INVENTION

The invention relates to a hinge device especially for furniture doors and including at least one mounting plate that can be fixed onto one part of the piece of furniture and which is provided with guides or recesses into which the anchorings of a hinge arm or of an intermediate part belonging to the hinge arm are insertable.

Conventional hinge devices of that kind have the advantage that the respective mounting plate can be fixed onto the respective part of the furniture, e.g. the side wall, before the assemblage of the furniture, and that during the assemblage the hinge arm itself, being linked to the door by swivel arms, need only be inserted onto said mounting plate. That is, at the time at which the whole door is to be carried by the hinge, the further necessary installation operations do not require very much time or precision.

In the conventional hinge devices the hinge arm or an intermediate part belonging thereto is inserted into guides of the mounting plate and afterwards fixed by means of a setscrew which abuts against the mounting plate.

SUMMARY OF THE INVENTION

The object of the present invention is to provide guides and anchorings which are especially easy to produce.

According to the invention this is achieved by the fact that the anchorings are directed laterally outwardly.

In a preferred embodiment the anchorings are flaps bent outwardly from the lateral flanks of the hinge arm or the intermediate part.

The arrangement according to the invention offers essential advantages from the point of view of production technology as compared with the conventional guides of hinge arms or intermediate parts which are directed towards the inside and which embrace the mounting plate from the outside.

What is essential in this consideration is the fact that at present the hinge arm or the intermediate plate belonging thereto are made of metal and consist e.g. of punched or stamped parts, while for the mounting plates plastic materials are more and more coming into use.

From the point of view of production technology it is by far easier to bend e.g. the lateral flanks of the hinge arm towards the outside than towards the inside along their edges to produce corresponding flaps serving as anchorings which are insertable into guides of the mounting plate.

For the moulding of the mounting plate, however, it is immaterial, whether the guides are open towards the inside or towards the outside.

BRIEF DESCRIPTION OF THE DRAWINGS

An embodiment of the invention is described hereinafter in detail with reference to the figures of the attached drawing, wherein.

DETAILED DESCRIPTION OF THE INVENTION

Figure 1:
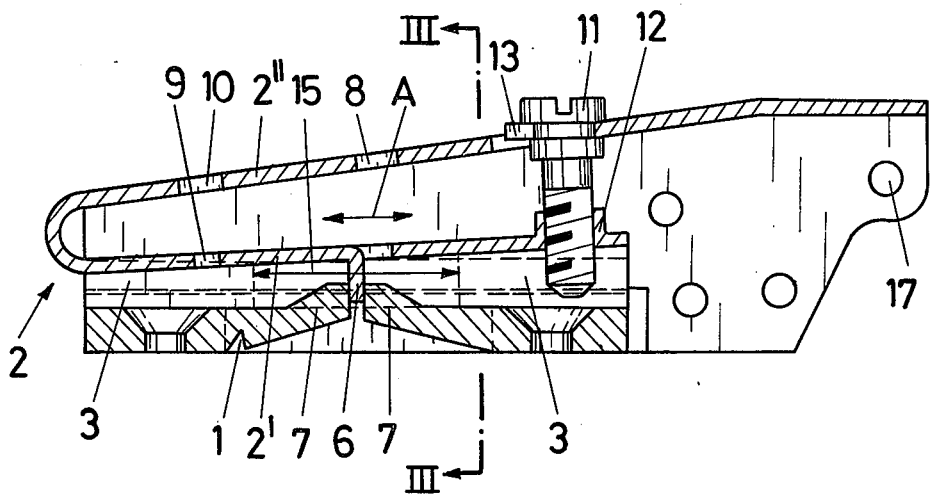
FIG. 1 is a longitudinal section of a hinge device according to the invention, taken along line I—I of FIG. 2.

In the figures of the drawing the furniture side wall 19 as well as the other parts belonging to the hinge, such as swivel arms, a hinge boss at the door 18, etc, are not shown, as they are not necessary for an explanation of the invention itself and since they belong to the prior art known to everyone skilled in the art.

The hinge device according to the invention has a mounting plate 1 which is fixable onto a part of the furniture, e.g. a side wall 19, by means of screws, dowels or the like.

Figure 2:
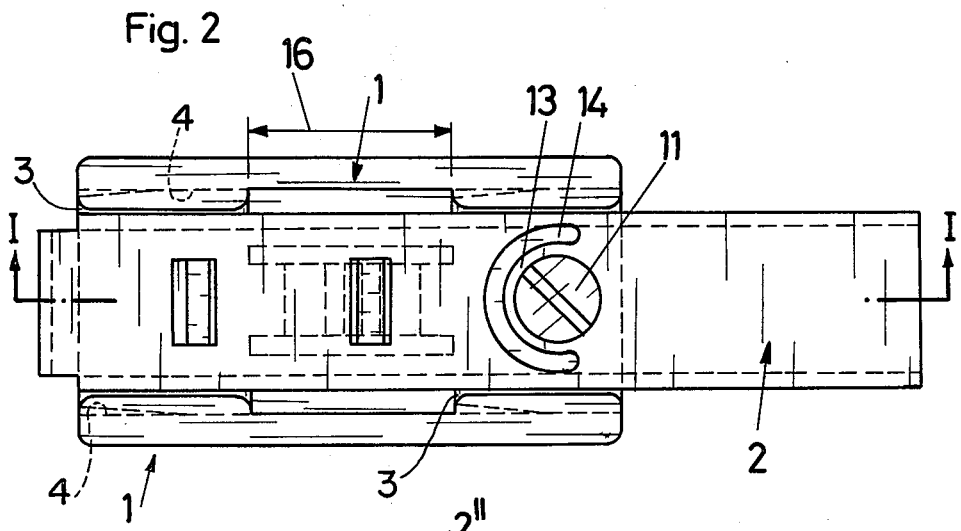
FIG. 2 is a top elevational view of a hinge device according to the invention.

The mounting plate 1 is provided with recesses or guides 4 on opposite lateral sides thereof, at both the front and rear ends thereof, i.e. at the right and left sides as viewed in FIGS. 1 and 2, into which guides 4 the lateral arms or projections 3 of the hinge arm 2 are insertable.

In the illustrated embodiment the projections 3 are represented by flaps bent outwardly from the lateral walls 5 of the hinge arm 2.

The flaps or projections 3 are also arranged both at the front and rear ends of the hinge arm 2, at a distance from each other, thus producing an interspace 15 between the flaps on each lateral side of hinge arm 2 equal to the interspace 16 between the front and rear guides 4 on each side of the mounting plate 1.

This embodiment allows the hinge arm to be centrally mounted onto the mounting plate 1 by inserting projections 3 at one end of hinge arm 2 into the interspaces 16, and then sliding projections 3 longitudinally into recesses 4.

Accordingly, hinge arm 2 need not be displaced along its whole length to be mounted on mounting plate 1, thereby considerably shortening the length of the insertion path.

In the illustrated embodiment the hinge arm 2 is provided with a centering part 6 represented by a pin, which in mounting position fits into a slot between two flaps or lips 7 of the mounting plate 1. The lips 7 are elastic parts of the mounting plate.

The pin 6 and the lips 7 eliminate the need for a particular fixing screw for tightening hinge arm 2 in place on plate 1. Furthermore the symmetric form of the mounting plate 1 prevents the plate from being mounted in the wrong direction.

As can be seen from FIG. 1 the longitudinal sectional configuration of the hinge arm 2 is represented by an approximately U-shaped part, the hinge arm 2 thus having a lower or inner load bearing portion 2' anchorable in the mounting plate 1 and an upper or outer holding portion 2'' provided with the bearings 17 for the swivel arms. Load bearing portion 2' and holding portion 2'' are bent and joined to each other at the end of hinge arm 2 opposite the swivel arm bearings 17.

As can also be seen from FIG. 1 the hinge arm 2 is provided with perforations 9 and 10, one of which being arranged in the upper portion 2'' and one in the lower portion 2'.

The perforations 9 and 10 permit the portions 2' and 2'' to be moved in the direction of the arrow A by means of an inserted tool, e.g. a screw driver. This represents the adjustment and readjustment possibility of the hinge in the direction of the depth of the furniture.

The portions 2′ and 2″ of the hinge arm 2 are furthermore connected at their front ends by means of an adjustment screw 11. This adjustment screw 11 screws into a thread 12 of the lower portion 2′ and is attached, e.g. by riveting, into a flap 12 of the portion 2″. Flap 13 is formed by the semicircular slot 14.

By turning the adjustment screw 11 the portion 2″ of the hinge arm 2 can be lifted from or pressed towards the portion 2′, i.e. the furniture side wall, thus permitting adjustment of the gap between the edge of the door 18 and the furniture side wall 19.

The flap 13 prevents the adjustment screw 11 from hindering the hinge arm 2 from being adjusted in direction of the depth of the furniture.

For this reason the thread 12 is not exactly round, but rather is slot-shaped, thus permitting a slight movement of the adjustment screw 11 during the adjustment in the depth direction.

Figure 3:
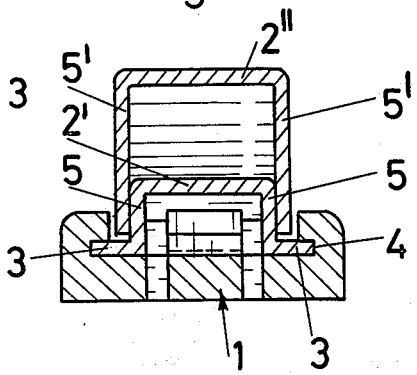
FIG. 3 is a section taken along the line III—III of FIG. 1.
Figure 4:
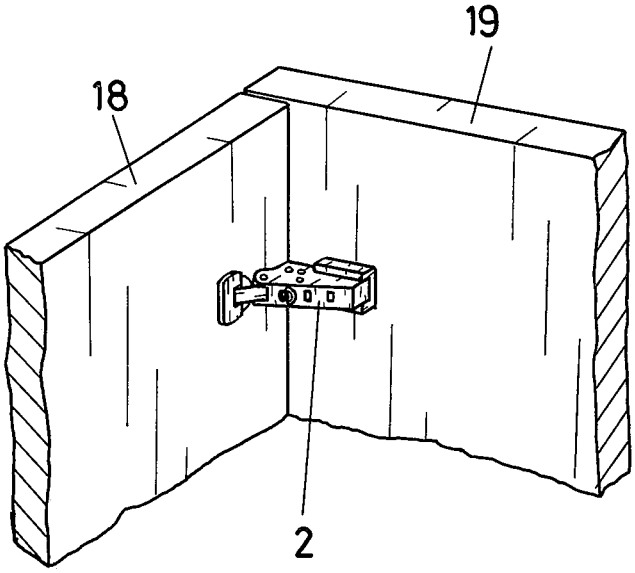
FIG. 4 is a perspective view of a furniture door fixed to a side wall by a hinge according to the invention.

Furthermore it should be mentioned that both the lower portion 2′ and the upper portion 2″ of the hinge arm 2 have U-shaped cross sections as shown in FIG. 3 and that the lateral flanks or sides 5′ of portion 2″ overlap the lateral sides 5 of portion 2′ in a certain area and are in contact with each other. This fact prevents the upper portion 2″ from being pulled downwardly by the weight of the door.

What we claim is:

1. In a hinge device, especially for furniture doors, of the type including at least one mounting plate that can be fixed to one part of a piece of furniture, and a hinge arm anchored directly or indirectly to said mounting plate and which bears swivel arm means for connection to another part of the piece of furniture, the improvement wherein:

said mounting plate is provided on opposite lateral sides thereof with inwardly directed guides; and said hinge arm is provided on opposite lateral sides thereof with outwardly directed projection means for insertion into respective of said guides.

2. The improvement claimed in claim 1, wherein said projection means comprise flaps bent outwardly from lateral flanks of said hinge arm.

3. The improvement claimed in claim 1, wherein said hinge arm includes an outer holding portion and an inner load bearing portion, said outer and inner portions being integrally joined at one end thereof, said swivel arm means being borne by said outer portion at a second end thereof, and said projection means extending laterally outwardly from said inner portion.

4. The improvement claimed in claim 3, wherein each of said outer and inner portions have lateral flanks, said flanks of said outer portion being overlapped and in contact with said flanks of said inner portion.

5. The improvement claimed in claim 1, wherein said mounting plate has at opposite longitudinal ends thereof said inwardly directed guides, said mounting plate thus having on each lateral side thereof a pair of guides, said guides on each said lateral side being spaced in the longitudinal direction.

6. The improvement claimed in claim 5, wherein said hinge arm has at opposite longitudinal ends thereof said outwardly directed projection means, said hinge arm thus having on each lateral side thereof a pair of projection means, said projection means on each said lateral side being spaced in the longitudinal direction.

7. The improvement claimed in claim 6, wherein the spacing between each said pair of guides is equal to the spacing between each said pair of projection means.

* * * * *